US005240307A

United States Patent [19]

Jones et al.

[11] Patent Number: 5,240,307

[45] Date of Patent: Aug. 31, 1993

[54] FOLDING PICNIC TABLE

[75] Inventors: Steven R. Jones, Newton; Matthew D. Buchanan, Olney, both of Ill.

[73] Assignee: Heartwood Industries, Inc., Newton, Ill.

[21] Appl. No.: 933,733

[22] Filed: Aug. 24, 1992

[51] Int. Cl.[5] ..... A47B 39/06

[52] U.S. Cl. ..... 297/159

[58] Field of Search ..... 297/157, 159; 108/113, 108/127

[56] References Cited

U.S. PATENT DOCUMENTS 3,273,936 9/1966 Deavers ..... 297/159
4,415,199 11/1983 Wright ..... 297/159
4,648,652 3/1987 Van Kuren ..... 297/159
4,700,987 10/1987 Sraka et al. ..... 108/113 X
4,877,237 10/1989 Goble ..... 297/157 X
5,018,785 5/1991 Monson et al. ..... 108/113 X

*Primary Examiner*—Lloyd A. Gall
*Attorney, Agent, or Firm*—Polster, Lieder, Woodruff & Lucchesi

[57] ABSTRACT

A folding picnic table with separately removable seats running parallel to long edges of a table top, requires three removable bolts at each end to assemble, and two removable bolts to hold in folded position for storage. A seat support is connected to pairs of folding legs. The seats and seat supports have holes for receiving the bolts in the folded condition.

2 Claims, 2 Drawing Sheets

FOLDING PICNIC TABLE

BACKGROUND OF THE INVENTION

The folding picnic table art is an old and crowded one. The closest art of which applicants are aware is a patent to Hansen, U.S. Pat. No. 4,060,275 issued Nov. 29, 1977. The design of the Hansen table is ingenious; the present invention has the advantages of simplicity of construction and somewhat increased versatility over the Hansen table.

SUMMARY OF THE INVENTION

In accordance with this invention, generally stated, in a folding picnic table having an elongated, substantially planar top and legs hinged to the underside of the top at either end, battens across the underside of the top, a seat support at each end of the table parallel to the plane of the top, fastened to and extending beyond the legs, and seats extending parallel to and along sides of the top and supported by the seat supports, an improvement is provided that includes a hinge block secured to the underside of the top at each end of the top, a hinge pin mounted in and projecting from the block at each side transversely of the top, on which a leg is mounted by way of a passage through the leg, and a brace bolt block secured to the underside of the table inboard of the hinge block. The brace bolt block carries fixedly a brace bolt, projecting downwardly from the underside of the table. An elongated two-ended brace at each end of the table is mounted at one end to the brace bolt by a nut and at its other end to the seat support intermediate the legs by a nut threaded on a bolt extending removably through a brace bolt hole in the seat support. The seats have pairs of battens at either end, the battens of each pair being spaced a distance closely but slidably to receive an upper edge of the seat support and of a height to receive a seat mounting bolt through aligned holes in the battens and the seat support, the bolt receiving a seat holding nut. The seats have bolt holes complementarily spaced and positioned with respect to the holes in the seat support to receive bolts therethrough when the legs and seat support are in folded condition. The seat support brace bolt-receiving hole is positioned to receive the brace bolt when the table is in folded condition, whereby only three removable bolts are employed at each end to assemble the table and seats, and two, to hold the table and seats in folded condition. Preferably the nuts are wing nuts.

DESCRIPTION OF THE PREFERRED EMBODIMENT

Figure 1:
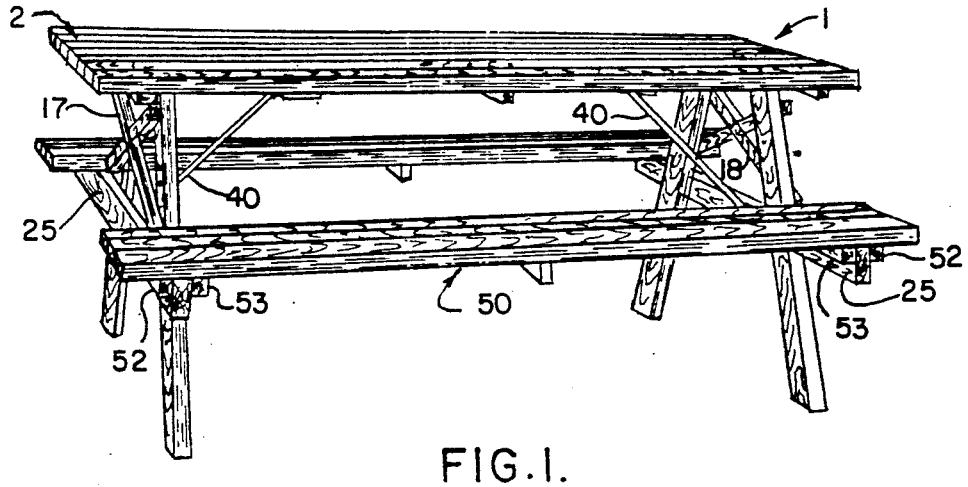
FIG. 1 is a view in perspective showing one illustrative embodiment of folding table of this invention.
Figure 2:
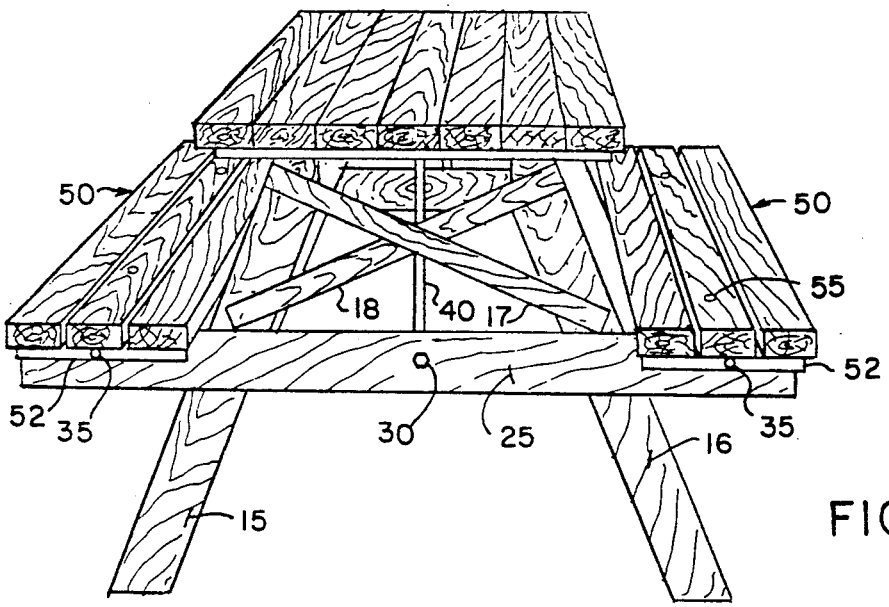
FIG. 2 is a view in perspective from one end of the table shown in FIG. 1.

Referring now to the drawings for one illustrative embodiment of folding table of this invention, reference numeral 1 indicates the erected table. In this illustrative embodiment, the table 1 is symmetrical about both center lines, and the parts at either end and either side are assigned the same reference numerals. The table 1 has a substantially planar top 2, shown as made up of seven 2×4 inch (nominal) cedar boards mounted tightly side by side by means of battens 3 and 4 extending transversely of the long dimension of the boards across the underside of the top, to which the boards are secured by nails, staples or the like. Also secured to the underside of the table top 2 are hinge blocks 10.

Figure 5:
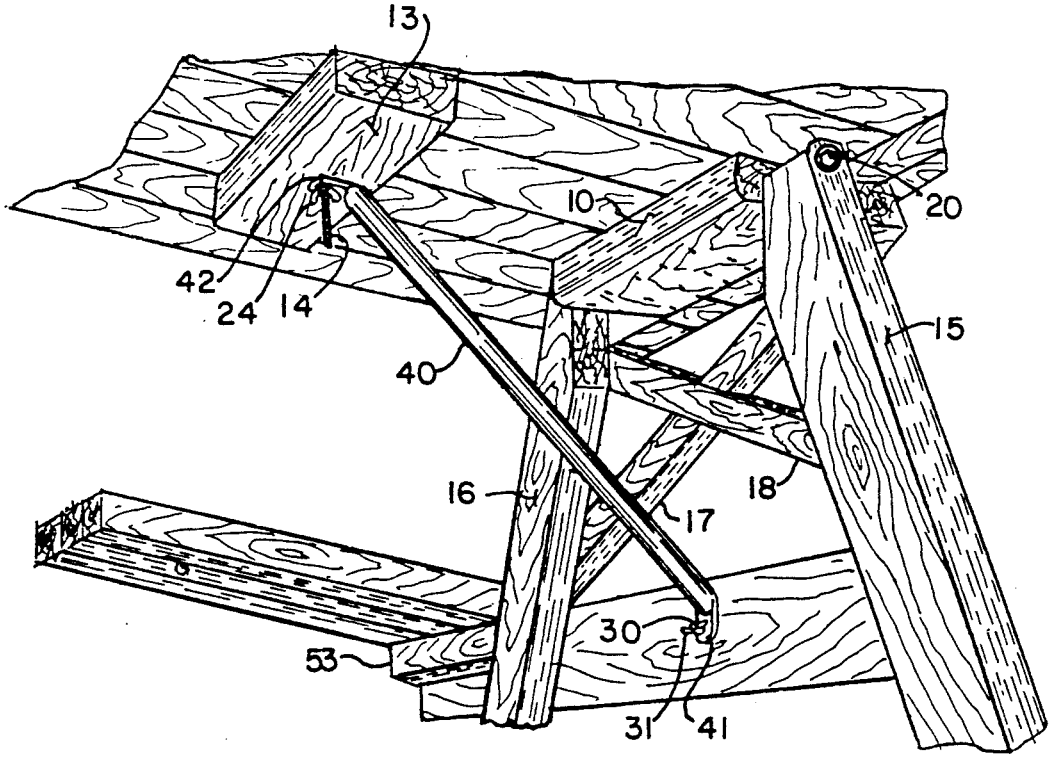
FIG. 5 is a view in perspective similar to that of FIG. 4, showing details of a brace and brace bolt block, and hinge block.

Splayed legs 15 and 16, scarfed at their inner upper ends to make the upper edges facing the hinge block parallel with end edges of the hinge block 10, are pivoted to the hinge block 10 by means of hinge pins 20 which, in this embodiment, are lag screws, extending through suitable holes in the legs and into the hinge block 10, as shown particularly in FIG. 5.

Cross braces 17 and 18 are secured to the legs near their upper ends. A seat support 25, parallel to the plane of the top 2, is nailed or otherwise secured to the outboard surfaces of the legs 15 and 16.

Also secured to the underside of the table top is a brace bolt block 13, best shown in FIG. 5, from which a brace bolt 14 projects. Brace bolt 14 serves a double function, as will be explained hereinafter.

Each of the seat supports 25 has three bolt holes extending transversely through it. One, at its center lengthwise, takes a removable brace bolt 30. The other two, receive seat retaining bolts 35.

End braces 40, tubular and elongated, have ears 41 and 42 at their ends, with holes in them through which, at one end, the brace bolt 14 extends, and through the other of which the removal brace bolt 30 extends. Wing nuts 24 and 31 hold the end brace in place.

Seats 50, in the embodiment shown, are made up of three cedar 2×4's, fastened in side by side relation by seat battens 52 and 53 secured to the underside of the seats transversely of the long dimension of the seats. The battens 52 and 53 at each end are positioned and spaced from one another to form a channel into which the upper end of the seat support 25 is received. The seat battens 52 and 53 have aligned holes in them, positioned complementarily to the hole in the seat support that receives the seat retaining bolt 35, which extends through both seat battens and through the hole in the seat support, to mount the seat securely on the seat support. A wing nut 36 is threaded on the bolt 35 to hold it in place. Generally in each place in which a wing nut is used, a washer is placed around the bolt first.

Figure 3:
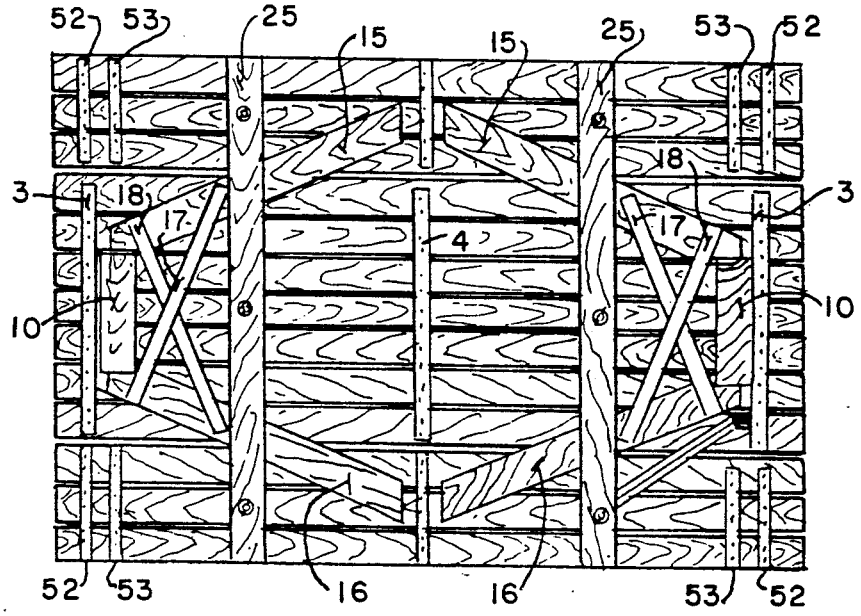
FIG. 3 is a plan view of the table in folded condition.
Figure 4:
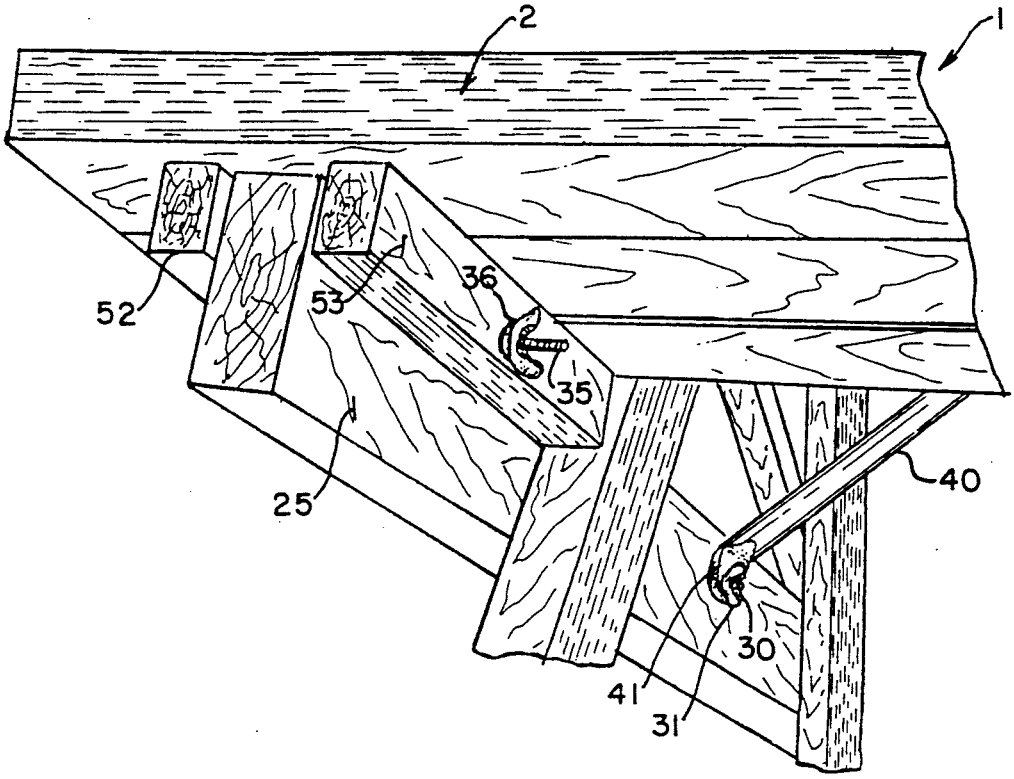
FIG. 4 is an enlarged fragmentary detailed view showing the underside of a seat bolted to a seat support.

When the table is to be folded for storage, the various wing nuts are removed, and the bolts 30 and 35 removed to release the seats and the end brace 40 which is slipped off the bolt 14. The bolts 35 are passed through holes 55 in the center board of the seat 50. The table is laid flat on its upper surface, the seats 50 are laid alongside the long sides of the table top, as shown in FIG. 3, and the legs are folded down around the pivot pins 20 to the position shown in FIG. 3, the bolts 35 and the bolt 14 passing through the respective holes in the seat supports 25. Those holes are sufficiently large to accommodate the slight transverse movement of the seat support with respect to the bolts. The same wing nuts that were threaded onto the bolts 35 and 14 can be used to tighten against the seat support 25, holding the seats in place, and the legs securely against the underside of the table top. In its folded condition, the table is little more than five inches deep, from the top surface of the top 2 to the outer surface of the seat support 25. Thus it can easily be stored against a wall in a garage or the like. The bolts 30 and their accompanying nuts can be mounted in bolt holes through the battens 52 and 53 for safe keeping. The end braces 40 can be tucked under a seat support 25.

As can be seen, the table is extremely simple to assemble and fold, and yet provides a sturdy, stable picnic table when it is erected. Either or both of the seats may be removed, if it is desired to stand close to an edge of the table top for serving purposes, or when using the table as a work bench.

Having thus described the invention, what is claimed and desired to be secured by Letters Patent is:

1. In a folding picnic table having an elongated, substantially planar top and legs hinged to the underside of said top at either end of said table battens across said underside of said top, a seat support at each end of said table, fastened to and extending beyond the said legs, and seats extending parallel to and along long sides of said top and supported by said seat supports, the improvement comprising a hinge block secured to said underside of said top and each end of said top, a hinge pin mounted in and projecting from said block at each side transversely of said top, on which one leg is mounted by way of a passage through said leg, a brace bolt block secured to the underside of said table inboard of each said hinge block, said brace bolt block fixedly carrying a brace bolt projecting downwardly from the underside of said table; an elongated, two-ended end brace at each end of said table mounted at one of its ends to said brace bolt by a nut and at its outer end to the seat support intermediate the legs by a nut threaded on a bolt extending removably through a brace bolt hole in said seat support; said seats having pairs of battens at either end, the battens of each pair being spaced a distance closely but slidably to receive an upper edge of a seat support and of a height to receive a seat bolt through aligned holes in said battens and said seat support, said seat bolt receiving a seat holding nut, said seats having bolt holes complementarily spaced and positioned with respect to hole in the seat supports to receive bolts therethrough when the legs and seat supports are in folded condition, and said seat support brace receiving holes being positioned to receive said brace bolts when in said folded condition.

2. The improvement of claim 1 wherein each of said bolts has a wing nut threaded to it.

* * * * *